United States Patent [19]

Barro

[11] 4,343,145

[45] Aug. 10, 1982

[54] ROTATING RING

[75] Inventor: Giovanni Barro, Imola, Italy

[73] Assignee: Officine Savio S.p.A., Pordenone, Italy

[21] Appl. No.: 190,185

[22] Filed: Sep. 24, 1980

[30] Foreign Application Priority Data

Sep. 24, 1979 [IT] Italy ..... 83458 A/79

[51] Int. Cl.[3] ..... D01H 7/56

[52] U.S. Cl. ..... 57/124

[58] Field of Search ..... 57/119, 122, 124

[56] References Cited

U.S. PATENT DOCUMENTS

| | | | |
|---|---|---|---|
| 2,725,712 | 12/1955 | Rooney | 57/124 |
| 3,494,120 | 2/1970 | Chilpan et al. | 57/124 X |
| 3,563,187 | 8/1951 | Pennati | 57/124 |
| 3,981,135 | 9/1976 | Huber et al. | 57/124 |
| 4,028,873 | 6/1977 | Shulz et al. | 57/124 |
| 4,279,119 | 7/1981 | Marzoli | 57/124 |

*Primary Examiner*—Donald Watkins

*Attorney, Agent, or Firm*—Stevens, Davis, Miller & Mosher

[57] ABSTRACT

The invention relates to a rotating ring for spinning frames, advantageously for ring spinners comprising a rotating ring arranged coaxially in a fixed body by the interposition of an annular cage enclosing a plurality of spheres.

Lateral shielding encloses the annular cage. Included is a brake cooperating with the cage enclosing spheres, and containing a pin sleeve and spring to carry out the required brake adjustment.

The rotating ring is made in at least one piece.

18 Claims, 7 Drawing Figures

ROTATING RING

The present invention relates to a rotating ring device appicable to spinning and twisting frames of known types, as for instance ring spinners.

More particularly the invention relates to a rotating ring in which the cursor is provided on or connected to a rotating ring which is coaxially placed within a fixed ring sustained by the machine's support bench and constructed in the form of roller bearings.

The present invention particularly relates to a rotating ring device which includes adjustable filament braking and tensioning means, acting on the cage of the bearing spheres or cylinders which is interposed between the fixed ring and the rotating one on which is connected the cursor or the traveler.

Rotating ring devices are already known which include rotating rings within fixed rings whereby the rotating ring is directly sustained in the fixed ring by pneumatic or hydraudynamic means or by means of roller bearings.

In these known devices, the traveler which receives the filament can be a sliding cursor which may also be connected to the rotating ring, or the traveler may be substituted by a radial hole provided in the upper part of a rotating ring.

In the IT 48806 A/79 for instance the rotor cooperates with a cage in which one or more elements, due to the centrifugal force, slide on the stator or on the body of the fixed ring acting thus as a brake. The filament is passed through a special eyelet provided in the rotor.

Another braking system is described in FR OS 2.353.659 and makes use of a plurality of blades whose internal extremities are bent downwardly.

Such blades are arranged radially within holes provided in the rotating ring and extend externally outwardly so that, due to the centrifugal force, the blades are hooked to the internal wall of the rotating ring, while they slide on the surface of the fixed ring, to slow down the rotation of the rotating ring.

This known system has many drawbacks because the blades are unable to generate a satisfactory braking effect and wear out rapidly. In addition, the blades must be changed for different counts of filament used.

One other known system is proposed by BE 864.437 and deals with a braking effect which makes use of the centrifugal force of at least one blade element arranged in a radial hole provided on the rotor of the bearing, such a blade pressing against the surface of the stationary part or the fixed ring.

This system has, in addition to the inconveniences relative to the preceding systems, other drawbacks since it is difficult to change the blades when a filament of different count is used and it is also expensive due to the high degree of precision required. Furthermore, it is not sufficiently reliable.

U.S. Pat. No. 3,494,120 (DE 1.809.730) provides a rotating ring sustained and guided by a fluid cushion, but the problem related to braking is not solved with the usual modality, speed of response and repetitiveness required by the modern spinning techniques specially in the transient phases.

The Great Britain Pat. No. 345.419 provides a rotating ring sustained by a bearing with elastically everpressed brakes acting on the internal rotating ring.

It is to be noted that this system is not satisfactory in the transient moments and does not conform adequately to the requirements of spinning on a modern ring spinning frame. In addition the device is complicated.

U.S. Pat. No. 3,981,135 describes a rotating ring supported by sliding or skidding.

The braking action is achieved by friction due to the gradual thinning of the supporting fluid which is itself displaced due to the geometric configuration of the pieces.

The patent DE PS 311.516 deals with a suitably shaped ring integral to a rotating annular slider sustained by a bed of spheres.

The rotating annular slider is guided on the remaining three sides and contact pressure on the spheres bed is adjustable by means of a rubber pad which apparently is circumferential.

This specification teaches braking the rotation of the traveller by controlling the form of the balloon according to the requirement of the filament. This regulation system beside being laborous is impossible for modern spinning frames.

The Great Britain Pat. No. 329.838 proposes a rotating ring whose weight can be increased, for varying the inertia, by rings positionable thereon.

This solution is neither advantageous nor realizable in modern spinning frames which work at a very high velocity.

In fact this solution has many problems related to the aerodynamics, lubrification and cleaning of the spinning frame and above all to the safety of holding the auxiliary rings.

The patent DE PS 826.716 shows a rotating ring with an aerodynamic brake cooperating with the ring itself.

This proposition is complex, costly and difficult to adjust and calibrate.

In fact the filament has to be worked in an inconvenient way lacking the orientability of the auxiliary ring and having to be worked in a turbulent flow of air which makes its correct introduction into the withdrawal spindle difficult.

The French Pat. No. 1.009.799 shows a electromagnetic braking device cooperating with the rotating ring. Such a system, undoubtedly valuable, has some technical solutions that make it unattainable.

This invention relates essentially to an electromagnetic braking system, but it is in itself very remote from the experience of the applicant and of the solutions experimented with and realized by the same.

All the above known types are unsatisfactory during the work phase and above all during the braking phase, each for its own reasons but none of them fully satisfies the requirements imposed during the transient phase, i.e. during the starting and stopping of the reel.

Braking systems employing elements that exploit the centrifugal force do not satisfy the requirements since the action they generate is a function of the rotational velocity and the inertia of the rotating elements plays a prejudicial part, thus rendering the movement of the rotating ring less responsive to changes in the operational conditions, specially those transitory ones, which can cause considerable damage and may lead to the breakage of filament.

In the second type of systems, the inertia of the rotating parts varies with changes in the operational conditions, the variations of the rotational speed of the rotating ring in the transient conditions are subjected to the inertia forces of the moving masses which fact renders such a solution inappropriate.

In the electromagnetic braking systems, in order to be suited to the requirements of the filament such action must be variable with the braking time, in addition, the initial and final periods of the electromagnetic effect generate secondary anomalous undesirable conditions.

The present invention aims at reducing and eliminating the above-said drawbacks by providing a rotating ring in which are provided means suitable for generating a braking action, adjustable at will, substantially independent of the rotating system and the inertia of the masses, particularly suitable for executing the task of braking in a stable manner and always at the required degree even during the transient conditions of starting and braking.

It is also a scope of the invention to provide a simple rotating ring device of simple construction and maintenance, as well as of simple and rapid adjustment as a function of the operational parameters.

An advantage, derived from the solution according to the present invention, is the fact that the cage of the bearing spheres is involved in the generation of the braking effect in a very simple manner in such a way that neither the said cage nor any other part of the device have a special or complicated form of construction.

Another advantage is derived form the fact that the braking action is adjusted according to the count of the filament worked, by acting on the braking pressure without having to change any component of the rotating system.

An advantage is also the capability of the device to dissipate the braking energy and the subsequent increases of temperature, due to the fact that the braking action itself is confined to the bearing cage only which is substantially isolated from the rotating and fixed rings.

This means that increases of temperature can not at all adversely effect the filament.

The above-cited scopes and derived advantages, as well as other scopes and advantages which will become apparent hereinafter, are achieved by the present invention which provides a rotating ring device consisting of a rotating ring arranged coaxially within an annular seating of a fixed body by the interposition of a roller bearing including an annular cage enclosing a number of very small spheres, advantageously three in number, which can also be cylinders, three in number but could also be five.

One of the bearing tracks is provided in the external lateral surface of the rotating ring and the other track is provided in the internal face of the annular seating of the fixed body.

According to the invention, the rotating ring is advantageously formed of at least two parts, one of which includes the track for the spheres and the other forms the rotating sleeve.

According to the invention, the element that includes the bearing track has an elongated circumferential configuration and radial configuration with at least an extension.

The rotating sleeve element can be formed of one or more pieces depending on the ease of construction and is advantageously made of plastic in order to reduce weight.

The rotating sleeve element includes either a hole for the passage of the filament or for holding the traveler ring in which the filament passes.

Advantageously the bearing cage is closed by two protection shields which are anchored and positioned in the fixed body and which leave the rotating part uncovered.

There are also provided adjustable braking and tensioning means which are externally actuable and arranged to cooperate with one surface of the bearing cage.

According to the invention the adjustable braking and tensioning means can be of various forms such that one can have a braking shoe kept resiliently pressed, a shoe kept pressed by the thrust of a fluid, or a shoe kept normally resiliently pressed and during the transient conditions is assisted by a thrust generated by a fluid.

In the case where the thrust on the shoe against the bearing cage is generated by a fluid one substantially has a small piston which acts on the shoe or acts as a braking shoe itself.

According to the invention, the thrust of the shoe against the bearing cage is adjusted in accordance to the count of the filament worked by acting on the pressure of the fluid or the spring load which is obtained either manually or automatically in order to generate the correct filament tension.

Furthermore, according to the invention, the braking means can be temporarily conditioned to the transient behavior by a suitable signal generated, for example, by the spindle's coming to a standstill, or by the breakage of the filament or another signal that can be obtained.

According to the invention it is also possible to attain the braking action with the help of a magnetic element, having braking or variable magnetism, which cooperates in a constant or variable manner with a metallic element provided in at least part of the bearing cage.

It is also possible to obtain the braking action by a jet of fluid under pressure with constant or at least partially variable properties cooperating with at least one surface of the bearing cage.

The invention is thus summed up by a rotating ring arranged coaxially within a fixed body by the interpositioning of an annular cage enclosing a plurality of spheres. There is provided lateral shielding cover means characterized by the fact that they are provided with adjustable braking means cooperating with the bearing cage. There also is provided means for exerting the required braking action.

Hereinafter a description is given by way of example of some preferential embodiments of the invention where the essence of the invention can be better illustrated and exposed.

Figure 1:
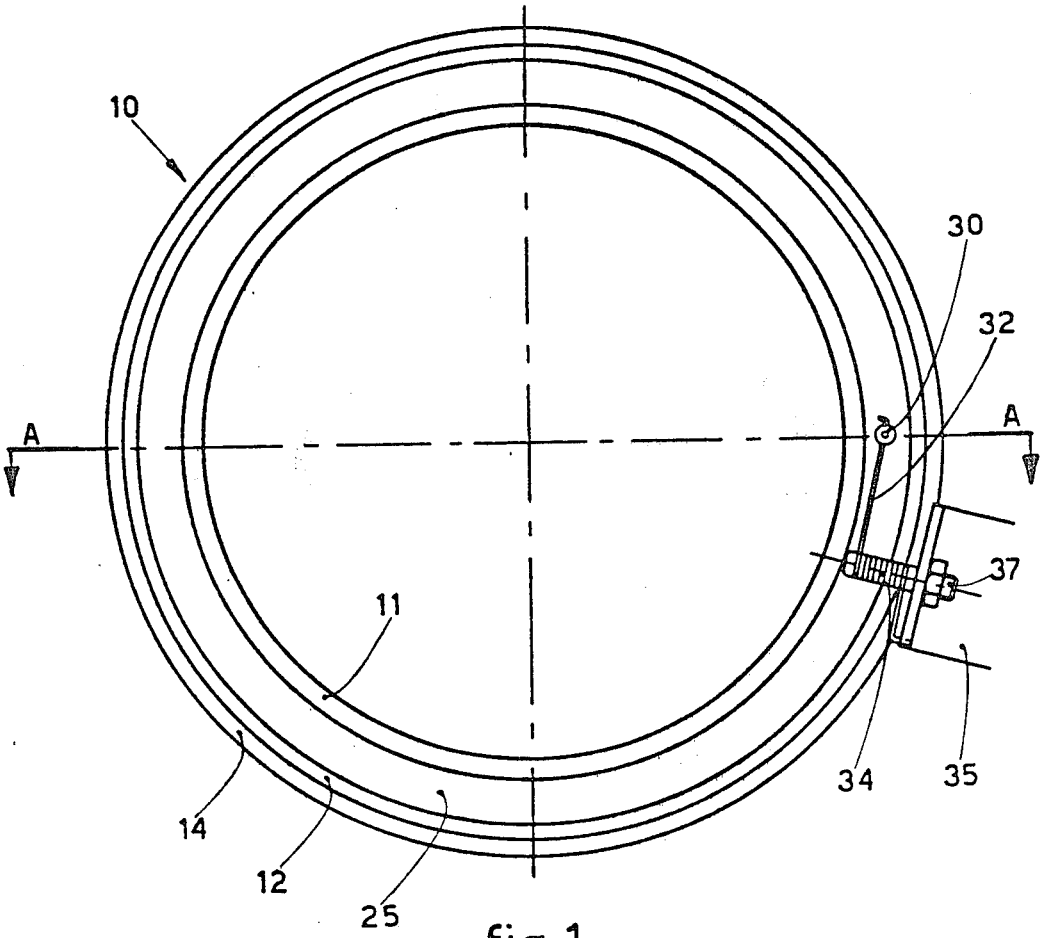
FIG. 1 is a plan view of the rotating ring device according to the invention illustrating the lower side thereof.

In the drawings, the device subject matter of the invention is generically indicated by 10, the rotating ring is generically shown as 11 and the fixed ring as 12.

The fixed ring 12 is sustained on the bench 13 advantageously by means of an anchorage 14 in plastic material, said fixed ring 14 being advantageously integral to the fixed ring 12.

The cage 15 of spheres 16 is interposed between the rings 11 and 12 within chamber 17, said cage 15 encloses a minimum number of spheres 16 and it was found that their number is advantageously three.

The rotating ring 11, in the example, is composed of two coaxial annular parts, a sleeve element or internal rotating part 19 and external rotating element or internal annular part 18.

The internal element part 18 is advantageously made at least partially in metal with a C or T section or another section with high axial and radial resistence.

The part 18 includes, on the external face thereof, a track 20 for the spheres 16; a corresponding track is provided in the internal part of the fixed ring 12.

The internal rotating part 19 is advantageously made of plastic material or similar very light material with an external edge in the upper end 21 as well as an external intermediate annular flange 22 cooperating with the fixed shield or flange 24.

In the vicinity of the external edge 21 a hole is provided where a small ring or traveler 45 is fixed, such a hole may itself serve for the passage of the filament.

The said annular flange 22 includes an annular projection 23 having a V shaped section arranged on the lower side and cooperating with a similar and conforming seating 28 which is part of the shielding element 24.

The bearing chamber 17 is closed by two shields 24 and 25 anchored in special grooves 26 and 27 provided in the fixed ring 12.

The labyrinth formed by the projection 23 can be formed in another way, by providing more than one projection 23.

The cage 15, enclosing the spheres 16, has a lightened cylindrical form with substantially flat lateral surfaces, one of which at least is arranged to cooperate with the braking means of the braking shoe type 29 actuated by braking pressure regulation means.

The means of braking pressure regulation can be resilient means 32 or fluid pressure means 40 or mixed means.

It has been found that the shoe 29, in the case where the braking pressure is generated by resilient means 32 (FIG. 2) can be advantageously replaced by a chip provided at the end of spring wire which rests on the lateral surface of the cage 15.

It is also found that the chip does not cause furrows in the cage 15, with use.

For generating the braking, or the required retardation of rotating ring 11, it is sufficient that the shoe 29 be pressed against the external surface of the bearing cage 15 by means of pressure adjustable in relation to the requirements of the worked filament.

Figure 2:
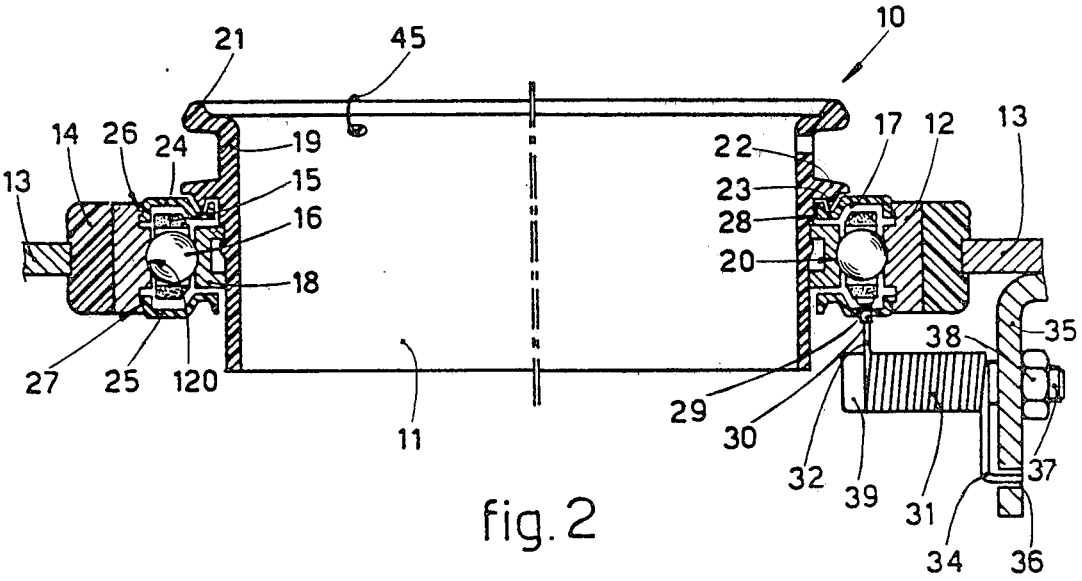
FIG. 2 is a cross-section of the device according to line A—A of FIG. 1.

The embodiment of FIG. 2 provides for the braking pressure to be maintained by a helical torsion spring 31 whose free end is provided with a braking shoe 29 and inserted within chamber 17 through hole 30 provided in the shield 25.

The other end 34 of the torsion spring 31 is anchored to a support 35, in the example, by insertion in holes 36, the spring 31 being wound about a pin 37 screwed onto the support 35 and champed in the example by nut 38.

Pin 37 has a slotted head for receiving a screw-driver so as to facilitate adjustment.

For adjusting the braking force it is sufficient to turn the head 39 of pin 37 by a screw-driver, since the screwing or unscrewing respectively increases or decreases the torsional load of spring 31, which load is transmitted to the braking system through shoe 29.

The adjustment of the pre-load is obtained by displacing the end 34 of spring 31 into one or the other of holes 36 provided around the pin 37.

Figure 3:
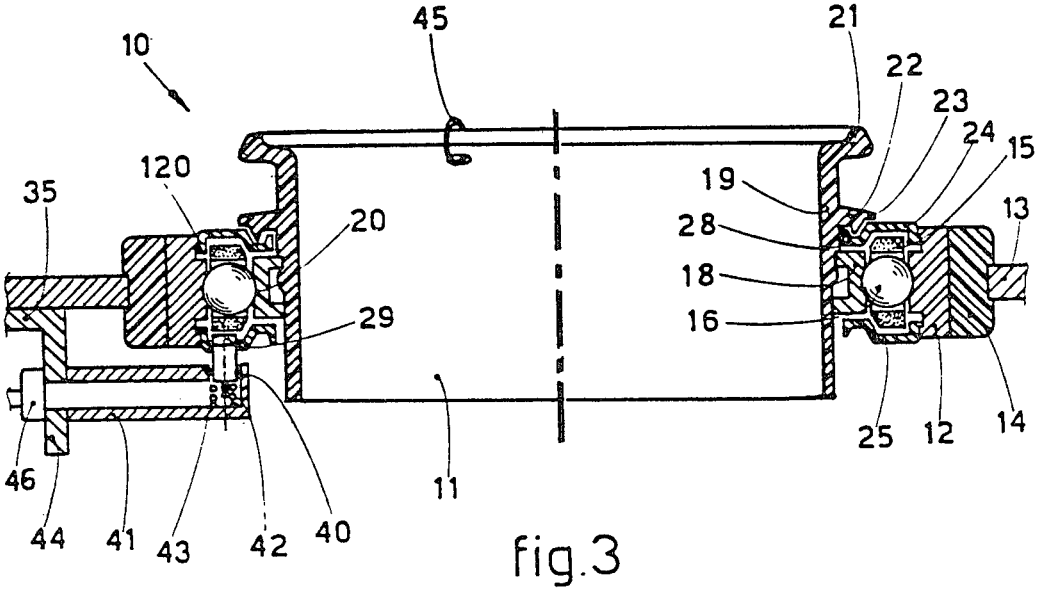
FIGS. 3 and 4 are cross-sections of the device according to alternative embodiments.

The alternative embodiment shown in FIG. 3 of the braking system envisages instead that the braking shoe 29 cooperates with a small piston 40 supported within a suitable sleeve 41, there being eventually provided a pressure spring 42 as well as eventual known means of hydraulic sealing 43.

The sleeve 41 is anchored to support 44 which is in turn fixed to bench 13.

In order to generate the required braking thrust on shoe 29, sleeve 41 is connected to a source of fluid under pressure, for example, compressed air 46.

The pressure of the fluid is adjusted according to the requirements of the filament being worked in order to generate a proportional braking action, which at the introduction of pressurized fluid can be minimal or even non-existent.

Furthermore, the arrest of the rotating part, when it becomes necessary to stop the spinning operation, can be enchanced by temporarily increasing the pressure of the fluid coming from 46.

Figure 4:
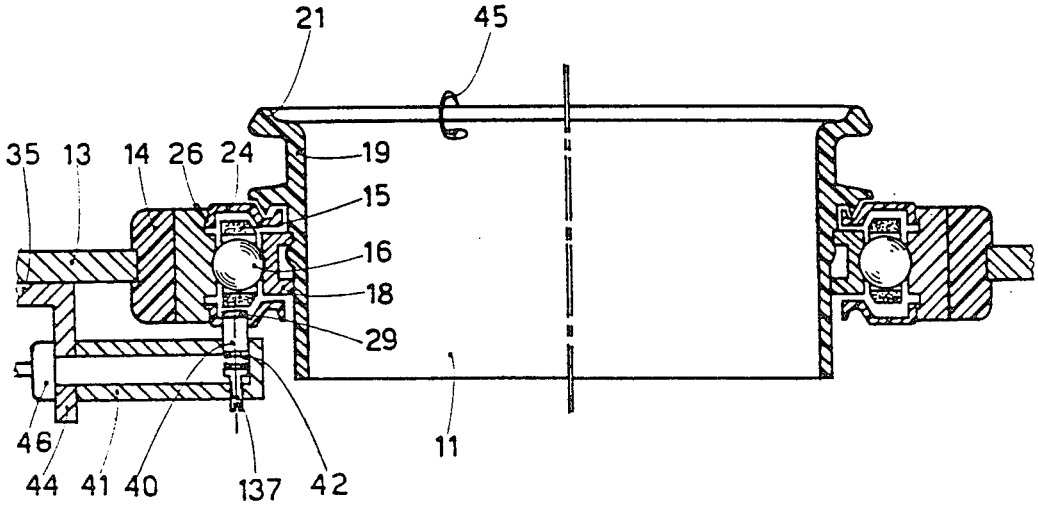

In the example illustrated in FIG. 4 the small piston 40 always cooperates with the pressurized fluid, as indicated above, but the pressure of the spring 42, which is constantly active, can be adjusted by means of screw 137.

This makes it possible to have a constant nominal braking pressure both during normal work conditions and transient conditions, while in the transient conditions only the pressurized fluid can increase or decrease such braking pressure as may be necessary.

Figure 5:
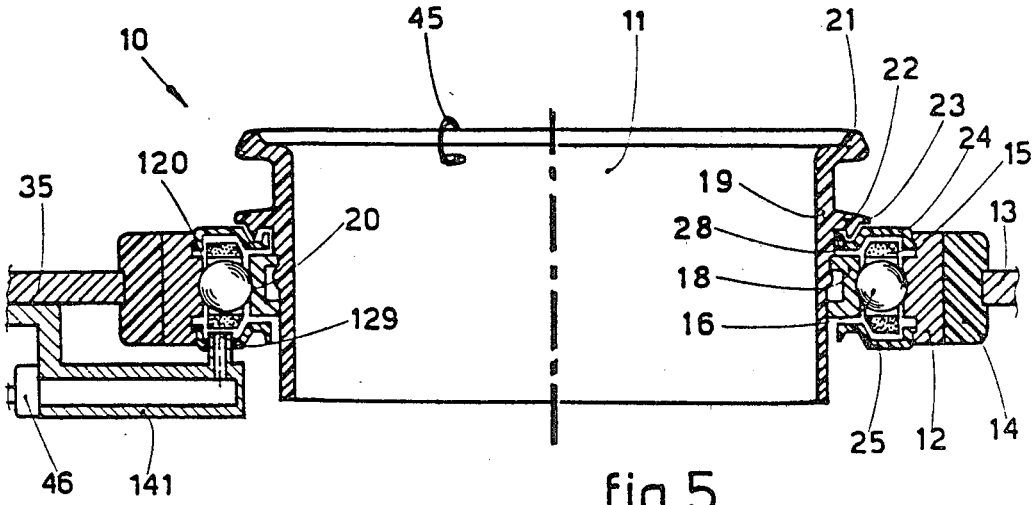
FIGS. 5 and 6 are cross-sections of the device with a fluid brake.
Figure 6:
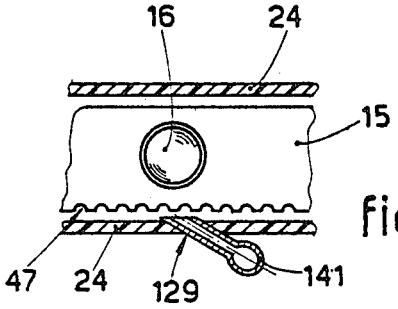

FIGS. 5 and 6 illustrate a braking system utilizing a fluid under pressure.

The pressure of such fluid can be constant or variable as required.

According to the invention, from sleeve 141, a nozzle 129 emerges which cooperates with part of the cage 15 of spheres 16.

This part may be a lateral surface of the cage 15 or a lower surface as in FIGS. 5 and 6.

The part with which the nozzle 129 cooperates can be equipped with appropriate notches 47.

The nozzle may have any axial inclination with respect to impact surfaces of the cage 15.

Figure 7:
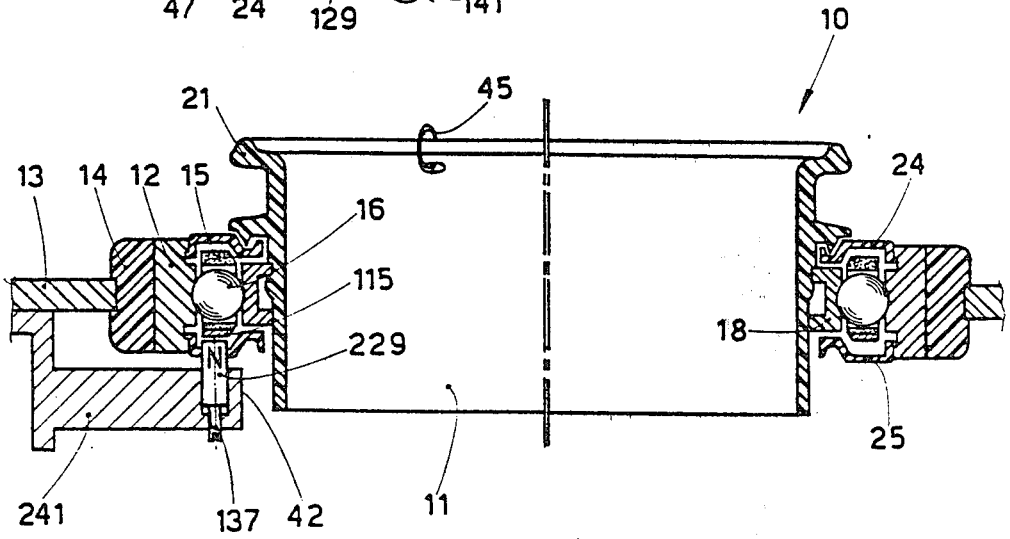
FIG. 7 is a cross-section of the device with a magnetic brake.

In FIG. 7 a magnet 229, axially adjustable with respect to the cage 15, is provided. On the cage 15 a metallic ring 115 is provided which feels the flux of magnet 229. The ring can be closed or with variable thickness and width or may be discontinuous at will and made of many segments.

The air gap can be adjusted in the example by acting on screw 137.

The permanent magnet 229 can be replaced by an electromagnet whose field can be varied at will.

In the same manner the permanent magnet 229 can be so equipped as to be able to have two positions; one of braking and another of ample air gap.

The positions can be taken either by means of manual or automatic actuation.

Ever since experimentation has begun with the braking action of the proposed devices exerted on the cage 15 no signs of deformations or exessive wear has been detected, while at the same time the braking action is smoothly transmitted to the rotating ring 11 without sharp jerks but with a gradual and smooth transfer of forces.

Some preferential embodiments of the invention have been described herein but many other variants within the ambit of the inventive concept are possible for a person skilled in the art.

In particular the forms and proportions of the various parts illustrated can be changed, the materials used can also be changed, one can also change the type and form of the braking thrust actuation means provided in the embodiments presented herein and this is because they may be obtained in different ways.

These and other alternatives are possible without going beyond the ambit of the inventive concept.

I claim:

1. Rotating ring device comprising a fixed body, a rotating ring arranged coaxially in said fixed body, an annular cage interposed between said ring and body, a plurality of spheres positioned within said annular cage, lateral means for shielding and closure of said cage, braking means cooperating with said cage and means for carrying out required brake adjustment.

2. The rotating ring device as in claim 1, wherein the braking means consist of a braking shoe acting on a lateral surface of said cage, said shoe cooperating with said means.

3. The rotating ring device of claim 2, wherein said means for exerting the required braking pressure consists of a helical torsion spring with an extremity thereof cooperating with said shoe and the other extremity engaging a support for adjusting and maintaining a pre-load.

4. The rotating ring device of claim 1 or claim 2, wherein said means for exerting the required braking pressure consists of a piston cooperating with a pressurized fluid.

5. The rotating ring device of claim 1 or claim 2, wherein said means for exerting the required braking pressure consists of cooperation between a piston, an adjustable compression spring and a pressurized fluid.

6. The rotating ring device as in claim 1, wherein said braking means consists of a nozzle directed at will and cooperating with a surface of said cage, said nozzle being suitable for issuing fluid under pressure.

7. The rotating ring device as in claim 6, wherein the surface of said cage with which the nozzle cooperates is provided with notches.

8. The rotating ring device as in claim 1, wherein said braking means consists of a magnet cooperating with a metallic element anchored to at least one portion of said cage.

9. The rotating ring element as in claim 8, wherein the braking magnetic effect of the magnet on the metallic element can be varied at will.

10. The rotating ring element as in claim 8 or claim 9, wherein said metallic element cooperating with said cage is a ring of appropriate dimensions.

11. The rotating ring device as in claim 10, wherein said fluid pressure can be varied at will.

12. The rotating ring device as in claim 5, wherein said fluid pressure can be varied at will.

13. The rotating ring device as in claim 6, wherein said fluid pressure can be varied at will.

14. The rotating ring device as in claim 7, wherein said fluid pressure can be varied at will.

15. The rotating ring device as in claim 1 including a traveler and wherein said rotating ring consists of an internal rotating part and an annular internal part, said internal rotating part having a seating for said traveler.

16. The rotating ring device as in claim 15, wherein said internal annular part includes a section vertically defining a bearing track and a radial section including at least one projection towards the inside.

17. The rotating ring device as in claim 1, wherein said internal rotating part includes in cooperation with said shielding means at least one labyrinth for protection against dust.

18. The rotating ring device as in claim 1 including a bench and anchorage ring and wherein said fixed body is connected to said bench by means of said anchorage ring.

* * * * *